United States Patent [19]

Stokes et al.

[11] Patent Number: 5,050,603

[45] Date of Patent: Sep. 24, 1991

[54] MOBILE VAPOR RECOVERY AND VAPOR SCAVENGING UNIT

[75] Inventors: Charles A. Stokes, Naples, Fla.; Daniel E. Steppe, Houston, Tex.

[73] Assignee: Public Service Marine, Inc., Irvine, Calif.

[21] Appl. No.: 261,760

[22] Filed: Oct. 24, 1988

[51] Int. Cl.[5] ..... F02M 17/16

[52] U.S. Cl. ..... 123/523; 55/385.1

[58] Field of Search ..... 123/523; 55/385.1

[56] References Cited

U.S. PATENT DOCUMENTS 4,270,506 6/1981 Lowe ..... 123/523

4,397,286 8/1983 Jackson et al. ..... 123/523

OTHER PUBLICATIONS

"Controlling Hydrocarbon Emissions from Tank Vessel Loading", Committee on Control and Recovery of Hydrocarbon Vapors from Ships and Barges, Marine Board Commission on Engineering and Technical Systems, National Research Council.

*Primary Examiner*—Noah P. Kamen

*Attorney, Agent, or Firm*—Pravel, Gambrell, Hewitt, Kimball & Krieger

[57] ABSTRACT

A mobile apparatus is provided for the recovery of emissions produced by the loading of cargos containing volatile organic compositions at land based or marine based terminals such as offshore oil produciton rigs. Hydrocarbon emissions have been found to elevate ozone levels in the lower atmosphere and the invention substantially eliminates these emissions by recovering the hydrocarbons emitted. The mobility of the apparatus offers the possibility of low cost use in terminals having a low cargo throughput by providing a high on-stream factor due to the ability to move the apparatus from one terminal to another as required.

6 Claims, 1 Drawing Sheet

MOBILE VAPOR RECOVERY AND VAPOR SCAVENGING UNIT

BACKGROUND OF THE INVENTION

1. Field of Invention

This invention relates to the recovery of volatile organic compounds (VOC) vapors for reuse or disposal in an environmentally safe manner.

2. Description of Prior Art

The release of volatile organic compounds (VOCs), especially hydrocarbons (HCs) into the atmosphere has been found to cause an increase in the ozone content of the lower atmosphere. Ozone is formed in the air as a result of photochemical reactions when HCs (such as gasoline vapors, paint fumes, or dry-cleaning fumes from solvents) combine with nitrogen oxides, oxygen, and sunlight. Ozone is a product of weather conditions, yet current knowledge of atmospheric chemistry is very limited. There is a seasonal pattern to VOC emissions, since a marked increase is VOCs occurs in the summer months as the heat causes gasoline and other hydrocarbon liquids to evaporate more quickly. At high concentrations, ozone can adversely affect human health, agricultural crops, forests, and other materials. See "Controlling Hydrocarbon Emissions from Tank Vessel Loading," Committee on Control and Recovery of Hydrocarbon Vapors from Ships and Barges, Marine Board Commission on Engineering and Technical Systems, National Research Council [hereinafter "Controlling Hydrocarbon Emissions from Tank Vessel Loading"], Appendix C at 177–178 (1987).

As a result of the harmful effects of ozone, the Environmental Protection Agency, (EPA), has established a primary ozone level standard to protect public health of 0.12 ppm (1-hour average) or 235 micrograms per cubic meter not to be exceeded more than one day per year. Currently the EPA is reviewing available scientific and technical information to determine whether the standard is adequate to protect human health and welfare. Some evidence suggests that even attainment of the existing standard for ozone will not protect public health with an adequate margin of safety. Id.

Because the states must devise State Implementation Plans (SIPs) to provide for the attainment of the NAAQS for ozone, the states are now searching for VOC sources where emissions can be reduced. Several states are now targeting the more difficult to control or smaller sources and thus are proposing that ships or barges that load VOCs be fitted with vapor control equipment. Id. at 194.

The cost of emission control is a central issue. Case studies conducted at the direction of the Committee on Control and Recovery of Hydrocarbon Vapors from Ships and Barges suggest that installing an operating vapor control facility, in order to achieve the maximum allowable limit of 3 lb of vapor emitted per 1000 barrels of product transferred, at a small terminal in Texas would add $0.008 per gallon of gasoline loaded while the cost at a larger terminal would increase costs by $0.0036 per gallon. Some smaller companies, especially in the inland barge industry, may have problems financing the necessary investments. Calculations confirm the strong dependence of cost effectiveness on terminal throughput. Id. at 108.

In addition to the cost problem, there are technical problems because available vapor recovery units are not operable or available for use in marine environments where terminals are space constrained and have safety constraints. For instance, the Coast Guard will not permit the use of a flare on a barge so that incineration of vapors produced while loading from an offshore marine terminal onto a boat would not be allowed. Moreover, in this circumstance, the available large stationary vapor recovery units would be expensive to install on the marine terminal and expensive to operate at low levels of utilization. Other government agencies such as the Office of Safety and Health Administration (OSHA) also have regulations which are directed to the safety of operating personnel and which constrain the operation of a conventional VRU under these conditions.

Hydrocarbon emissions also constitute a loss of product so that there may be an economic incentive to recover the hydrocarbon vapors if the cost of recovery is lower than the value of the product lost. These economics therefore depend upon the cost of equipment, the level of utilization of the capital equipment, the cost of operating the equipment, labor costs, etc., and the market value of the recovered vapors.

Current vapor control technology may be divided into three categories: (1) closed loading of tank vessels, more properly termed vapor balancing; (2) incineration; and (3) recovery processes.

Closed loading of tank vessels necessitates loading with all the hatches and ports closed. This is contrary to most barge practice but is routine on most large tank ships. It is noteworthy that the term "closed loading" does not necessarily imply the capture of vapors, rather, as a tank is being filled, the vapor in the free space above the level of the liquid being loaded is displaced upward into a pipeline which returns the vapor to the free space of the tank being emptied. Thus, the vapor is in effect recycled from the tank filling up to the tank being emptied.

Combustion or incineration processes are more than 98% efficient if operated properly. They can perform reliably as the sole hydrocarbon control process but even more reliably as polishing units. The primary drawback is that they do not recover the hydrocarbon product. The value of this incinerated hydrocarbon can be significant when crude or gasoline is being shipped. Furthermore, combustion devices can be relatively unsafe because they are potential sources of ignition for the flammable VOCs and hydrocarbon products. It is also noteworthy that the incineration process produces $NO_x$ which contribute to smog. Thus, incineration is to an extent a self-defeating method since it contributes to the very ill that is being sought to be eliminated.

Vapor recovery processes may be divided into three types: (1) lean oil absorption; (2) refrigeration; and (3) carbon bed absorption. Id. at 71. Lean oil absorbers operating at pressures of 100 to 200 psia are very efficient at recovering hydrocarbons from rich streams but less efficient at removing hydrocarbons from streams that contain little hydrocarbon. Typically, an absorber can remove up to about 95% of the ethane and heavier fraction of the vaporous hydrocarbon content of a feed stream by pressure increase and temperature decrease. At temperatures below 60° F., hydrate formation may cause freeze-up problems. If the system is under pressure, water can also freeze at temperatures above 32° F. Antifreeze can be used to lower the liquid hydrocarbon freezing point but this adds to operating costs. The absorption process can only reduce a vapor stream's hydrocarbon content to 1-3% (volume) of the initial ethane and heavier fraction economically. Thus, the absorber off gas should be routed to a polishing flare or incinerator. Id. at 72-73.

The direct refrigeration system removes hydrocarbons by cooling and condensing the vapors through a series of low temperature heat exchanges. This process has the advantage that very low temperatures are possible so that up to 99% of a stream's hydrocarbon content can be removed. However, in order to achieve this high proportion of hydrocarbon reduction, temperatures below 60° F. may be required and at these temperatures hydrates may form and plug the exchanger surfaces and lines. This can be avoided by the injection of ethylene glycol or other antifreezes. Even the best DRUs which employ vapor compression and expansion with regenerative heat exchange against very cold expander discharge refrigerants cannot remove ethane and heavier hydrocarbons to the very low levels required by regulatory authorities, i.e., three pounds of hydrocarbon vapor emitted per 1000 barrels loaded. The obvious solution would be to incinerate this stream in a flare, however, the use of such flares are a safety hazard and are unacceptable to the Coast Guard authorities for use on board a ship. Moreover, flares produce $NO_x$ and are to that extent counterproductive since $NO_x$ contributes to smog. Further, the DRU exit stream is so lean that hydrocarbon would have to be added to enrich it to enable combustion. This is a waste of product which was costly to recover in the DRU process. The safe, efficient disposal of lean light hydrocarbon vapor streams remains a problem.

Carbon bed absorbers use activated carbon or a similar absorptive material to absorb hydrocarbons selectively. After the absorptive capacity of the medium is used up, the hydrocarbon will "break through" and appear in increasing amounts in the exiting vapor stream. At this point, the medium is recharged. The spent carbon may be disposed of but if the volume is large enough, regeneration of the carbon can be cost effective. The best approach is to use a vacuum to desorb the hydrocarbon from the carbon. As an alternative, the hydrocarbon can be steam stripped from the carbon but this generates an oily waste water stream that has to be disposed of. Carbon beds do not do a good Job of recovering light ends such as ethane and propane. For use in marine applications, carbon beds would need to be very large to handle the high flow rates and hydrocarbon loadings generated.

It is noteworthy that while in the oil and chemical industry hydrocarbon vapors are recovered from streams that are essentially "steady state," in loading operation, the hydrocarbon composition and vapor quantity is not steady state. For example, at commencement of loading a crude oil the initial vapor is low in quantity and may consist largely of light hydrocarbons. As loading progresses, the quantity of the vapor increases and heavier hydrocarbons are also present in the vapor. Thus, a vapor recovery system for these operations must be able to cope with an unsteady state vapor stream.

The above technology is large and capital intensive. In order to obtain a return on the investment, a high level of utilization is necessary. These technologies may therefore be useful at large terminals where there is a high throughput of hydrocarbons and other products which produce VOCs during the loading and off-loading processes.

There are, however, a large number of smaller or remove terminals which do not have a large throughput of product and which also would produce VOCs during loading or off-loading processes albeit in small quantities but which nevertheless contribute to the overall VOC emissions. Among these are smaller land-based terminals and offshore oil production rigs. It would be prohibitively expensive to construct vapor recovery units on each offshore oil producing platform or at each small on-land terminal to recover the relatively smaller amounts of VOCs produced by each such source even though in sum they may produce an appreciable tonnage of VOCs.

SUMMARY OF THE INVENTION

The present invention solves the economic and technological problems associated with the recovery of VOC emissions produced at smaller or unique and remove sources by providing an apparatus and a process for the recovery of VOCs economically from small terminals having a low throughput and from offshore producing rigs and terminals. It is also suited for recovering at least a portion of the vapors produced at larger terminals where it could be used for instance to relieve the "turndown constraints" of larger fixed installed VRUs which are designed to operate at high vapor rates but which may on occasion be required to serve a very low vapor rate. Typically a large unit can only be turned down to a proportion of its design rate and not further. The instant invention, therefore, is useful at below the large unit's turndown ratio.

The instant invention also solves the problem of disposing of a lean light hydrocarbon stream in a safe and environmentally sound manner by providing a diesel engine adapted to utilize light hydrocarbons as a supplemental fuel safely and cleanly.

The apparatus of the instant invention is also relatively simple to operate and does not require trained graduate engineers as operators. Non-university graduates may be readily trained to operate the apparatus.

The instant invention is a mobile apparatus for the control of volatile organic compound (VOC) emissions, especially hydrocarbon emissions, produced in the loading and off-loading operations at terminals. The apparatus, being mobile, is readily movable from one terminal to another so that it has the potential for a high rate of utilization thereby providing cost effective service especially to low throughput terminals such as offshore oil production rigs and smaller on-shore terminals.

The invention has two basic embodiments: a ship or barge mounted vapor recovery unit (VRU) coupled to a vapor scavenging unit (VSU).

In its preferred embodiments, the VRU is a direct refrigeration unit which condenses vapors and recovers the liquid product. The VSU is either (1) a diesel engine, adapted to consume residual VOC exiting from the VRU as supplemental fuel, which drives an electricity generator or a hydraulic pump; or (2) a molecular sieve adsorber capable of absorbing VOCs.

BRIEF DESCRIPTION OF THE DRAWINGS

The sole drawing.

DESCRIPTION OF THE PREFERRED EMBODIMENTS

Figure 1:
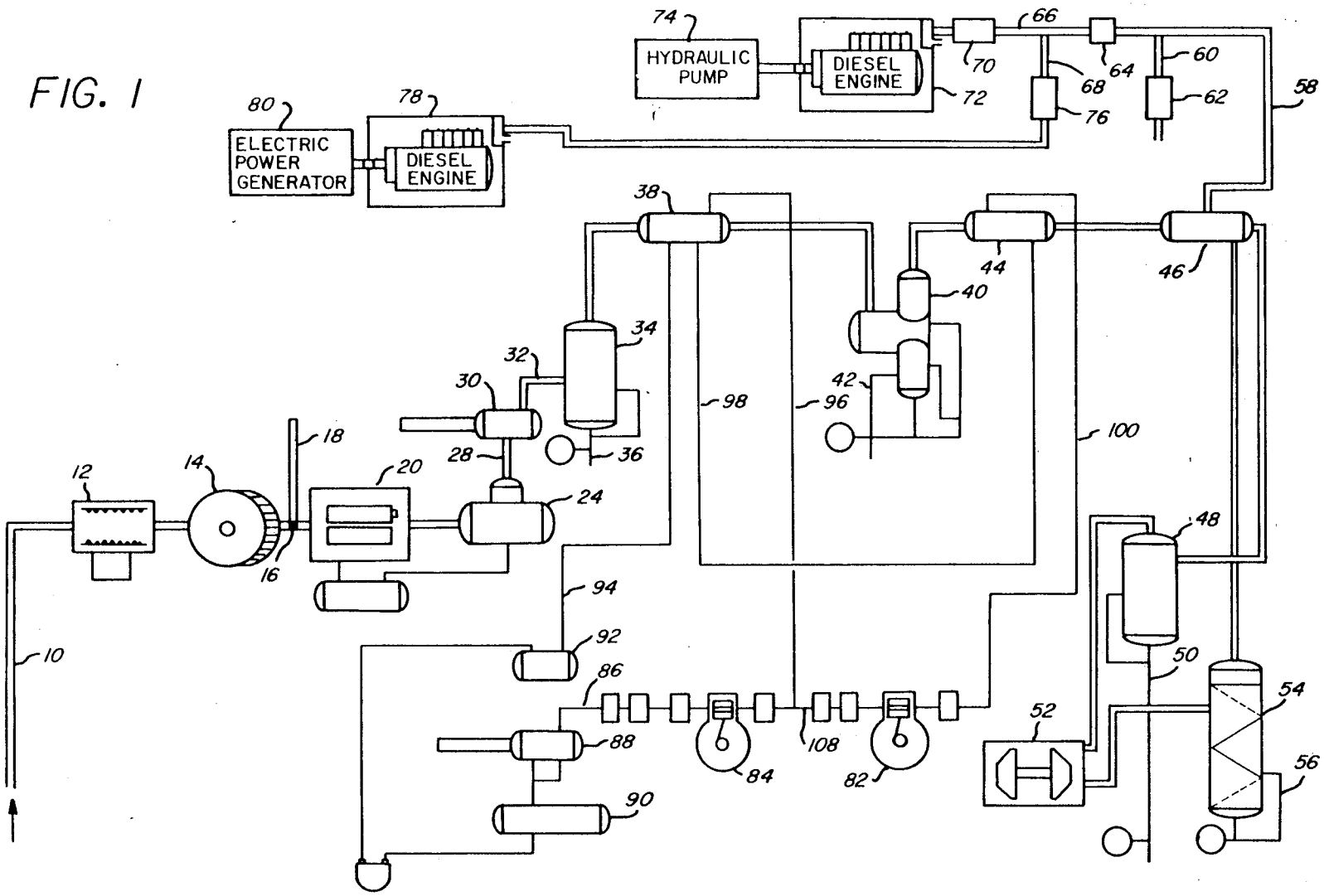
FIGURE 1, is a flow diagram showing the process flows in a preferred embodiment of the invention.

The term "volatile organic compounds" (VOC) refers to hydrocarbon or hydrocarbon derived compounds containing from 1 to 12 carbon atoms. The term "light VOCs" refers to hydrocarbon or hydrocarbon derived compounds having from 1 to 4 carbon atoms.

The term "light hydrocarbons" refers to $C_4$ and lighter hydrocarbons.

The term "vapor scavenging unit" is a process unit which is useful for the recovery or disposal by combustion or otherwise of light VOCs from a vapor stream. In its preferred embodiments, the VSUs of the instant invention include a diesel engine adapted to utilize light VOCs as supplemental fuel and a molecular sieve adsorber capable of absorbing the light VOCs.

The term "vapor recovery unit" (VRU) is a process unit comprising mechanical components such as compressors, heat exchangers, knock-out drums, separators, accumulators, distillation columns and the like together with associated controls and ancillaries as is typically used in the oil and chemicals industry which is useful for the recovery of volatile organic compounds from a process stream containing such compounds. Vapor recovery units include those processes used in the oil and chemical industries such as in cryogenic gas treatment and recovery by direct refrigeration, light lean oil absorption and activated carbon absorption. A VRU can also be designed to function as a VSU, as for instance, when it is designed to recover or dispose of light VOCs. There is not a sharp dividing line between a VRU and a VSU except that a VRU typically does not reduce the VOC concentration to zero because of economic considerations. For instance, in direct refrigeration vapor recovery units, the recovery of the lightest residual VOCs such as methane would require low temperatures and large heat exchange surfaces necessitating large compressors with attendant high energy costs and large heat exchangers. The process would also require high pressures which would add to both capital and operating costs. Economics do not favor a design to recover light VOCs such as methane and a less expensive option is to utilize a VSU which collects or disposes of these residual VOCs. In the specification and claims, those VRUs which are overdesigned to operate also as VSUs are regarded as a VRU unit and a VSU unit.

The term "platform" is not restricted to a platform in the sense of a flatbed but is intended to include structures for attaching process equipment to a ship or barge or skids or a trailer-type vehicle for use on land.

In its preferred embodiments, the invention utilizes a direct refrigeration unit (DRU) as a VRU. The preferred VSUs are either a diesel engine adapted to utilize light VOCs as a supplemental fuel which is coupled to either an electricity generator which provides some of the power needed by the apparatus, or to a hydraulic pump; or a molecular sieve adsorber capable of absorbing the residual light VOCs. The entire apparatus, including the VRU and the VSU is mounted upon a mobile platform. This mobile platform may be a wheeled platform such as a trailer or skids for use on land or a barge or ship which would permit use of the apparatus at, for example, offshore oil production rigs.

In the flow scheme of the preferred direct refrigeration process, the VOC emissions first pass through a feed line 10 to a caustic scrubber 12 where potential corrosive components in the vapor stream are removed. The flow of the vapor from the source through the caustic scrubber is induced by the induction effect of an inline blower 14 located downstream of the caustic scrubber. The blower is fitted with a valve 16 which may be opened to discharge the vapor through vent 18 to atmosphere in an emergency. From the blower, the scrubbed vapor passes to the inlet of an oil bathed screw compressor 20 which boosts the pressure of the vapor stream to about 75–125 psia and the temperature into the range 180°–210° F. The compressed vapors exiting from the compressor are fed to a liquid-vapor separator 24. The liquid stream 25 exiting from the bottom of the liquid-vapor separator is essentially hot water, free of oil, which may be recycled. The separated vapor stream exiting from the separator through line 28 passes through a compressor discharge cooler 30, utilizing cooling water as the cooling medium, which cools the stream to about 65°–80° F. The cooled vapor stream passes through line 32 to an after cooler knock-out drum 34 fitted with an oily water drain system 36 which drains into the cargo loading pipeline. The vapors then exit from the top of the knock-out drum and enter a first high temperature chiller 38 which is cooled with low pressure refrigerant to 25°–35° F. to produce a vapor-liquid mixture. This mixture is fed to a cold three-phase knock-out drum 40 which is fitted with a hydrocarbon liquid drain system 42 for recovering liquid hydrocarbons which are then reinjected into the cargo loading line. The vapor exits from the top of the three-phase knock-out drum and enters a low temperature chiller where it is cooled by low temperature refrigerant to between about −10° to −60° F. Upon exiting from the low temperature chiller, the gas passes through a gas-gas exchanger 46 where it is further cooled to between about −90° to −160° F. and partially condensed by heat exchange with cold expanded vapors and thence to a first low temperature accumulator 48 fitted with a hydrocarbon liquid drain system 50 for liquid hydrocarbon recovery. The residual vapors exit from the top of the low temperature accumulator and are fed to a turbo-expander 52 which expands the vapor to a pressure of between about 0 to 5 psig and cools the vapors to about −160° to −220° F. causing further vapor condensation. The cooled, expanded vapor-liquid mixture is fed to a second low temperature accumulator 54 fitted with a hydrocarbon liquid drain system 56 for recovering liquefied hydrocarbons for reinjection into the cargo. The cold separated vapor now mainly methane, with some ethane, propane and butane exits from the top of the second low temperature accumulator and is used as a cooling medium in the gas-gas exchanger 46 before entering the VSU process at a temperature of between about −10° to 20° F. and at about 0 to 3 psig.

The vapor entering the VSU process via line 58 may be rerouted to vent to the atmosphere via vent system 60 fitted with a flame arrestor 62. More typically, the vapor passes through a lower explosion limit detector 64 coupled to a cutoff valve. The vapor stream is then split into lines 66 and 68. The vapor in line 66 passes through a flame arrestor 70 before entering the intake of a modified diesel engine 72 used to drive a hydraulic pump 74 which powers all the rotating equipment except the blower 14. The vapor in line 33 passes through a flame arrestor 76 to the intake of a modified diesel engine 78 which drives an electricity generator 80 which powers a caustic scrubber sump pump, blower 14, instrumentation and lights.

Refrigeration is provided by low pressure 82 and high pressure 84 compressors fitted with ancillary filters, separators, and accumulators associated with such equipment. The compressed refrigerant exiting from the high pressure compressor is fed to a refrigeration condenser 88 via line 86. This refrigerant condenser is cooled with cooling water. The cooled compressed refrigerant is then fed to a refrigerant accumulator 90 from which it passes via a refrigerant subcooler 92 then via line 94 to the high temperature chiller 38 to provide cooling for the vapor stream. Part of the refrigerant exits from the high temperature chiller via line 96 and is routed back to the inlet of the high pressure compressor 84 for recompression and recycling. The remainder of the refrigerant then flows through line 98 to low temperature chiller 44 to provide cooling. The refrigerant exits from chiller 44 through line 100 and is routed to the inlet of the low pressure compressor 82. The low pressure compressor discharges refrigerant in line 108 which routes the refrigerant into the inlet of the high pressure compressor 84, thereby completing the cycle.

The internal combustion engine preferred for use as a VSU is a diesel engine adapted to utilize light hydrocarbons as fuel. This light hydrocarbon fuel (which is the light residue of the vapor emissions) is fed into the air intake system of the engine. Adaptations to the engine air intake system were essential to overcome the problem of explosive detonations within the engine which occur when it is fed with a lean hydrocarbon stream. On the compression stroke, an explosive mixture forms causing detonation, engine knock and ultimately mechanical failure. To overcome this, a detector was positioned to sense the composition of the air intake and to control a valve which diverts the hydrocarbons from the air intake when the explosive limit is approached. Using this control system and ensuring an excess supply of air to the diesel intake allows safe efficient operation of the engine.

Since the feed to the VSU should not exceed the lower explosion limit (LEL) of the vapor in the diesel engine, a control system is provided which allows operation of the VRU to maintain a VSU vapor stream composition below the LEL. This control system involves (1) monitoring the vapor feed rate and composition to the VRU and also the VSU feed rate and composition, (2) monitoring the amount of vapor recovered as liquid in the VRU, (3) monitoring the temperature (and hence vapor pressure) of the product being loaded, (4) monitoring the rate of product loading, and (5) performing a materials balance based on these data. Such calculations are known to those skilled in the art. From the results of these calculations, appropriate adjustments are continually made, mainly manually, for instance to decrease the refrigerant temperature or increase refrigerant rate in order to ensure that the vapor leaving the VRU is at below the LEL for feed to the VSU.

As an alternative to the diesel engine system shown in FIGURE 1 and described above, the light VOCs exiting from the gas-gas exchanger in line 58 may be fed to molecular sieve adsorbers in parallel. These are operated such that when one adsorber experiences a breakthrough, the other is brought on stream. The spent charge in the breakthrough molecular sieve adsorber may then be regenerated for reuse.

The invention has been described with reference to its preferred embodiments. Those of ordinary skill in the art may appreciate from the description changes and modifications which may be made to the invention and which do not depart from the scope and spirit of the invention as described above or claimed hereafter.

We claim:

1. A mobile anti-pollution apparatus, for the recovery of hydrocarbon emissions, comprising:

a) a mobile platform upon which is mounted b) a vapor recovery unit for recovering vapors including light hydrocarbons, said vapor recovery unit having an inlet and an outlet end, said inlet end adapted for coupling to an external source of hydrocarbon vapor emissions to recover a portion of the vapors including light hydrocarbons emitted therefrom, and said outlet end adapted for connection to a means for conveying unrecovered vapors to c) a vapor scavenging unit, said vapor scavenging unit comprising an internal combustion engine adapted for utilizing light hydrocarbons in the unrecovered vapors exiting from said vapor recovery unit as supplemental fuel.

2. The apparatus of claim 1, wherein said platform is mounted upon a vessel capable of navigating the oceans and navigable water bodies.

3. The apparatus of claim 2, wherein said internal combustion engine is a diesel engine adapted for utilizing light hydrocarbons as supplemental fuel.

4. The apparatus of claim 1, wherein said platform is mounted upon a wheeled structure for use at land-based terminals.

5. The apparatus of claim 4, wherein said internal combustion engine is a diesel engine adapted for utilizing light hydrocarbons as supplemental fuel.

6. The apparatus of claim 4, wherein said platform is fitted with skids.

* * * * *